US006693949B1

(12) United States Patent
Schubert et al.

(10) Patent No.: US 6,693,949 B1
(45) Date of Patent: Feb. 17, 2004

(54) METHOD AND DEVICE FOR OPERATING ELECTRIC ARC FURNACES AND/OR RESISTANCE FURNACES

(75) Inventors: Manfred Schubert, Oberhausen (DE); Peter Starke, Duisburg (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/980,160

(22) PCT Filed: Jun. 3, 2000

(86) PCT No.: PCT/EP00/05069

§ 371 (c)(1),
(2), (4) Date: Feb. 28, 2002

(87) PCT Pub. No.: WO00/75588

PCT Pub. Date: Dec. 14, 2000

(30) Foreign Application Priority Data

Jun. 4, 1999 (DE) ..... 199 25 599

(51) Int. Cl.[7] ..... F27D 9/00; F27D 1/12

(52) U.S. Cl. ..... 373/113; 373/71; 373/74; 373/76; 373/118; 373/122

(58) Field of Search ..... 373/42, 44, 71–72, 373/75–76, 109, 118, 122, 60, 74, 78, 81, 84, 2, 8, 9, 110, 112, 113, 137

(56) References Cited

U.S. PATENT DOCUMENTS

| | | | | |
|---|---|---|---|---|
| 2,622,862 A | | 12/1952 | Fernando | |
| 3,723,632 A | | 3/1973 | Beizerov | |
| 3,785,764 A | | 1/1974 | Delacroix et al. | |
| 4,065,634 A | | 12/1977 | Beizerov et al. | |
| 4,197,900 A | | 4/1980 | Bloshenko et al. | |
| 4,235,173 A | | 11/1980 | Sharp | |
| 4,870,655 A | * | 9/1989 | Ward | 373/60 |
| 5,052,018 A | * | 9/1991 | Meredith | 373/72 |
| 5,297,159 A | * | 3/1994 | Dung et al. | 373/72 |

FOREIGN PATENT DOCUMENTS

| | | |
|---|---|---|
| DE | 522567 | 3/1931 |
| FR | 1259396 | 2/1960 |

* cited by examiner

*Primary Examiner*—Tu Ba Hoang
(74) *Attorney, Agent, or Firm*—Friedrich Kueffner

(57) ABSTRACT

The aim of the invention is to provide a means of also cooling the lower part of electric arc furnaces and/or resistance furnaces. To this end, said lower part—the actual melting vessel (4)—is surrounded with a jacket (9) at a certain distance, forming a shell, and the resulting intermediate space is configured as a cooling device (10) and subjected to the action of a cooling medium (14).

10 Claims, 2 Drawing Sheets

METHOD AND DEVICE FOR OPERATING ELECTRIC ARC FURNACES AND/OR RESISTANCE FURNACES

BACKGROUND OF THE INVENTION

1. Field of the Invention

Figure 1:
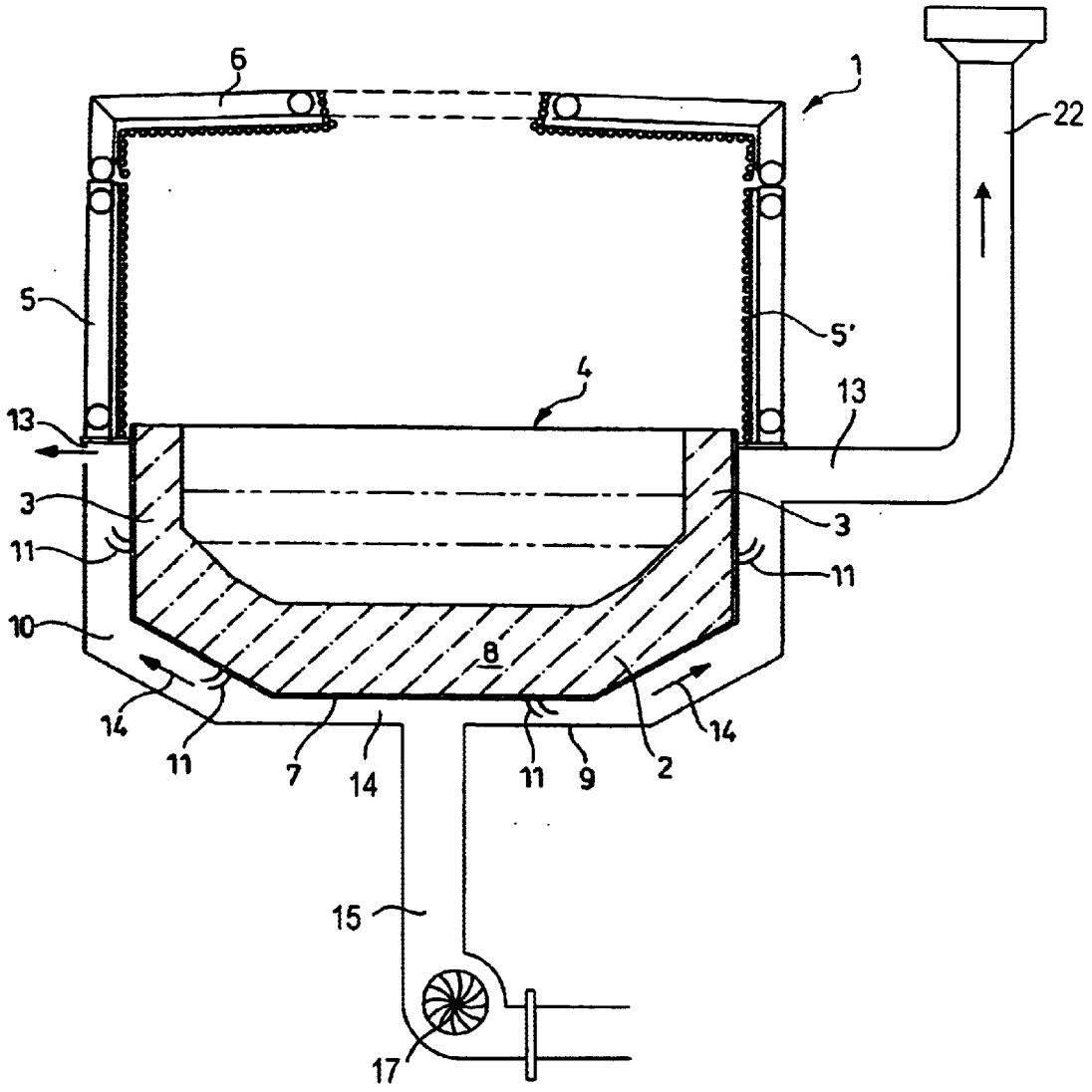

The invention relates to a method and a device for operating electric arc melting furnaces and/or resistance melting furnaces, comprising a melting vessel for receiving the molten mass, whose lid and upper lateral wall are cooled by a cooling medium, preferably water, up to or inclusive of the area of the slag zone.

2. Description of the Related Art

Such cooled furnaces are known in many modifications. In these known furnaces, the furnace bottom is the only area that is not cooled and has the tendency to undergo increased wear of the refractory lining and require increased repair expenditure of the construction elements.

In order to cool at least that part of the furnace bottom in which the bottom electrodes are located, it is known from EP 02 03 301 B1 to arrange in this area of the furnace bottom at a spacing a plate through which the necks of the electrodes or contact pins are guided and to blow air into the intermediate space between this plate and the furnace bottom. With this measure the bottom electrode is cooled during the melting and tapping operation wherein, for extended operational downtimes, the cooling efficiency can be adjusted, by reducing it, such that the rate of temperature change of the bottom electrode, in particular, at the beginning or the end of the operating downtime, does not surpass predetermined maximum values.

SUMMARY OF THE INVENTION

Based on this known prior art, it is the object of the invention to provide a method for operating electric arc melting furnaces and resistance melting furnaces with which the disadvantage of only a partial cooling can be prevented.

The above object is solved for electric arc melting furnaces and resistance melting furnaces of the described kind by a shell-shaped cooling device enclosing the lower part of the melting vessel and formed as a mantle corresponding to the contour of the outer furnace wall and arranged on the melting vessel at a spacing thereto, wherein at least one inlet opening and at least one outlet opening for the cooling medium are arranged on the cooling device.

By the measure of the invention to also cool the lower area of the furnace, the furnace bottom and the lower part of the lateral walls, a more beneficial effect is achieved as a whole in regard to the service life of the refractory lining as well as of the additional construction elements of the furnace. Moreover, with the measure the invention an advantageous cooling action is also exerted onto the bottom electrode.

The cooling according to the invention is realized by means of a shell-shaped cooling device, enclosing the area of the lower furnace to be cooled, through which the cooling medium flows. The cooling medium can be a gaseous material, for example, air, or a liquid material, for example, water.

For maintaining flow of the cooling medium within the cooling device, convection can be used in the simplest case wherein, in the case of air cooling, the convection can be enhanced by a chimney which is connected with the outflow opening of the cooling device. With this chimney, it is advantageously also prevented that flames can enter the cooling device during tapping of the furnace.

Should convection not be sufficient, according to the invention it is also possible to convey the cooling medium through the cooling device by means of a conveying device, for example, a pump or a blower, arranged externally to the cooling device. Particularly for liquid cooling media, it is beneficial to convey the cooling medium in a closed circuit through the cooling device. In this connection, the cooling medium which has been heated can be cooled advantageously such that a heat recovery is possible.

The flow speed and the temperature of the cooling medium determine the cooling efficiency of the cooling device so that, according to an advantageous embodiment of the invention, the cooling efficiency can be matched to the operating temperature of the furnace by changing these parameters by means of a measuring and control device.

The cooling device which encloses the lower part of the furnace like a shell is formed according to the invention in a simple way. By means of a sheet metal, which is shaped according to the furnace contour and is arranged on the furnace at a spacing thereto, a mantle-shaped hollow space is provided through which the cooling medium flows. The hollow space has at least one inlet opening and at least one outlet opening for the cooling medium, wherein in the case of convection the inlet opening is to be expediently arranged centrally at the furnace bottom and the outlet opening laterally at the top on the sidewalls. For a forced flow by means of a conveying device, the inlet and outlet openings can be arranged differently.

For improving the cooling action by means of the cooling medium, cooling ribs, which are fastened on the furnace wall, for example, by welding, are arranged according to an advantageous embodiment of the invention within the hollow space of the cooling device. These cooling ribs are configured such that they ensure an optimal cooling efficiency without, however, substantially increasing the flow resistance of the cooling device, for which purpose they are expediently curved in the flow direction.

In order to realize the possibility of heat recovery for cooling in a closed circuit, a heat recovery device is arranged in the cooling circuit lines in addition to the conveying device for maintaining the circulation, in which the heated cooling medium can be cooled and which uses the heat released thereby, for example, by storing it.

According to one embodiment of the invention, a measuring and control system, into which the measured values of the operating temperatures of the furnace are entered, is connected with this heat recovery device and with the conveying device in order to be able to affect the temperature and the quantity of the cooling medium flowing into the cooling device.

Further advantages, details and features of the invention will be explained in the following in more detail by means of an embodiment schematically illustrated in the drawing figures.

Figure 2:
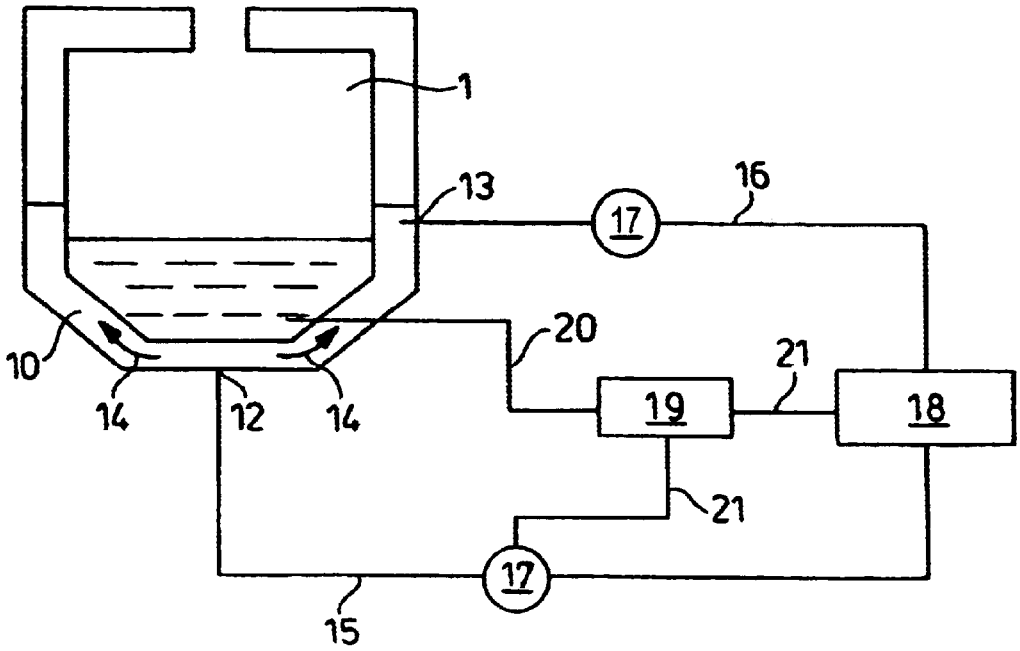

It is shown in:

FIG. 1 a vertical section of a furnace;

FIG. 2 a block diagram of a cooling circuit.

FIG. 1 show schematically a furnace 1 with a furnace bottom 2, lower lateral walls 3 on the melting vessel 4, upper lateral walls 5, and a lid 6. The upper lateral walls 5 extend downwardly up to approximately the melting vessel 4 containing the molten mass and are provided in this area, like the lid 6, with a water cooling device 5'.

The melting vessel 4 has a refractory lining 8, illustrated by hatching, and is formed by the furnace bottom 2 and the lower lateral walls 3. According to the invention, the melting vessel 4 is surrounded at a spacing by a mantle 9, preferably of sheet steel, which is formed according to the contours of the outer furnace wall 7. The thus resulting shell-shaped hollow space forms the cooling device 10 through which the cooling medium 14 flows.

The cooling medium enters in the illustrated embodiment by means of an inlet opening 12 centrally arranged at the furnace bottom 2, flows in the direction of the arrow to the lateral walls 3, and then exits the cooling device 10 at the upper end of the sidewalls 3 through the outlet openings 13. A chimney 22 is connected to one of the outlet openings 13. Within the cooling device 10, cooling ribs 11, shaped corresponding to the flow direction of the cooling medium 14, are arranged on the furnace wall 7 for improving heat transfer as well as for swirling the cooling medium 14.

In FIG. 2 one embodiment of a cooling circuit is illustrated in the form of a block diagram. The cooling device 10 of the furnace 1 and the melting vessel 4 is connected at its outlet opening 13 via the outlet line 16 with a heat recovery device 18. In this heat recovery device 18, the cooling medium 14 which has been heated during cooling of the melting vessel 4 is cooled with heat recovery. A conveying device 17, for example, a pump or a blower, which is arranged in the inlet line 15, forces the now cooled cooling medium exiting the heat recovery device 18 back into the cooling device 10 via the inlet opening 12. A conveying device 17 each may be arranged in the inlet line 15 and in the outlet line 16.

The heat recovery device 18 and the conveying device 17 are connected by control lines 21 with a measuring and control device 19 by which the conveying output of the conveying device 17 and the temperature of the cooling medium 14, in the heat recovery device 18, are controlled as a function of the operating state of the furnace 1. For this purpose, the measuring and control device 19 is connected by means of a measured data line 20 with corresponding measuring devices on the furnace (the measuring devices are not illustrated).

The invention is not limited to the embodiments illustrated in the drawing figures which, for improving the illustration, have been shown with an over-sized cooling device. Depending on the configuration and operational conditions of the furnace, according to the invention the shape and size of the cooling device, the number and arrangement of the inlet and outlet openings as well as the connection of the cooling device with other devices (measuring and control unit, conveying device etc.) can be configured variably when the basic principle of the invention is obeyed according to which an optimal cooling of the entire melting vessel is to be realized in a simple way with a construction and cost expenditure as minimal as possible.

What is claimed is:

1. A resistance melting furnace, comprising:

a melting vessel having a refractory lining and an outer furnace wall, the melting vessel having a furnace bottom and lower lateral walls;

an upper part cooled by a first cooling medium and comprising a lid and upper lateral walls;

a shell-shaped cooling device enclosing the outer furnace wall, wherein a second cooling medium flows through the cooling device and is in direct contact with the outer furnace wall, wherein the second cooling medium is transported in the cooling device by convection, a conveying device arranged externally on the cooling device and configured to convey the second cooling medium in addition to the convection of the second cooling medium.

2. The resistance melting furnace according to claim 1, wherein the cooling device has a mantle having a contour corresponding to a contour of the outer furnace wall, wherein the mantle is arranged on the melting vessel, wherein the cooling device has at least one inlet opening and at least one outlet opening for the second cooling medium.

3. The resistance melting furnace according to claim 2, wherein the inlet opening is arranged centrally at the furnace bottom and the outlet opening is arranged laterally at an upper end of the lower lateral walls.

4. The resistance melting furnace according to claim 1, further comprising a conveying device arranged externally on the cooling device and configured to convey the second cooling medium.

5. The resistance melting furnace according to claim 1, wherein the second cooling medium flows in a closed circuit through the cooling device.

6. A resistance melting furnace, comprising:

a melting vessel having a refractory lining and an outer furnace wall, the melting vessel having a furnace bottom and lower lateral walls;

an upper part cooled by a first cooling medium and comprising a lid and upper lateral walls;

a shell-shaped cooling device enclosing the outer furnace wall, wherein a second cooling medium flows through the cooling device and is in direct contact with the outer furnace wall, wherein the cooling device has cooling ribs arranged on the outer furnace wall.

7. A resistance melting furnace, comprising:

a melting vessel having a refractory lining and an outer furnace wall, the melting vessel having a furnace bottom and lower lateral walls;

an upper part cooled by a first cooling medium and comprising a lid and upper lateral walls;

a shell-shaped cooling device enclosing the outer furnace wall, wherein a second cooling medium flows through the cooling device and is in direct contact with the outer furnace wall, further comprising:

a heat recovery device, wherein the cooling device comprises an outlet line and an inlet line, wherein the heat recovery and the cooling device are connected to one another via the inlet line and the outlet line and form a closed circuit; and at least one conveying device arranged in at least one of the inlet line and the outlet line.

8. The resistance melting furnace according to claim 7, wherein the at least one conveying device is a blower or a pump.

9. The melting furnace according to claim 7, further comprising a measuring and control device having control lines and a measured data line, wherein at least one of the heat recovery device and the conveying device are connected by the control lines to the measuring and control device, wherein the measuring and control device is adapted to receive measured values of an operating temperature of the electric arc melting furnace or resistance melting furnace via the measured data line.

10. The resistance melting furnace according to claim 2, wherein the outlet opening is connected to a chimney for air convection cooling.

* * * * *